US010906717B2

(12) United States Patent
Weyrauch et al.

(10) Patent No.: US 10,906,717 B2
(45) Date of Patent: Feb. 2, 2021

(54) PALLET CONTAINER

(71) Applicant: MAUSER-WERKE GMBH, Brühl (DE)

(72) Inventors: Detlev Weyrauch, Kreuzau-Untermaubach (DE); Lukas Wahmes, Cologne (DE)

(73) Assignee: MAUSER-WERKE GMBH, Bruehl (DE)

( * ) Notice: Subject to any disclaimer, the term of this patent is extended or adjusted under 35 U.S.C. 154(b) by 141 days.

(21) Appl. No.: 15/761,709

(22) PCT Filed: Sep. 9, 2016

(86) PCT No.: PCT/EP2016/001523
§ 371 (c)(1),
(2) Date: Mar. 20, 2018

(87) PCT Pub. No.: WO2017/050420
PCT Pub. Date: Mar. 30, 2017

(65) Prior Publication Data

US 2018/0346220 A1 Dec. 6, 2018

(30) Foreign Application Priority Data

Sep. 23, 2015 (DE) ..... 10 2015 012 163

(51) Int. Cl.
*B65D 77/04* (2006.01)
*B65D 19/08* (2006.01)
(Continued)

(52) U.S. Cl.
CPC ..... *B65D 77/0466* (2013.01); *B65D 19/08* (2013.01); *B65D 19/385* (2013.01);
(Continued)

(58) Field of Classification Search
CPC .... B65D 77/0466; B65D 19/40; B65D 19/08; B65D 19/385; B65D 19/18
(Continued)

(56) References Cited

U.S. PATENT DOCUMENTS 5,738,240 A 4/1998 Vavra et al.
6,202,844 B1 * 3/2001 Sedlmayr ..... B65D 77/0466 206/386

(Continued)

FOREIGN PATENT DOCUMENTS

CN 1621316 6/2005
DE 9418078 U1 1/1995

(Continued)

OTHER PUBLICATIONS

English Translation of DE 10161693 (Year: 2003).*

(Continued)

*Primary Examiner* — Steven A. Reynolds
(74) *Attorney, Agent, or Firm* — Marshall, Gerstein & Borun LLP

(57) ABSTRACT

A pallet container for storing and transporting in particular flammable or easily ignitable liquid filling materials has a composite base plate, a thin-walled rigid internal container made from a thermoplastic plastics material, a tubular lattice frame that as a supporting jacket tightly encloses the plastics-material internal container, and a base pallet on which the plastics-material container bears and to which the tubular lattice frame is fixedly connected. The plastics-material internal container is on all sides enclosed by a fire-protection insulation mat. The composite base pallet is equipped with a heat-resistant support element for maintaining the resistance thereof in the case of heat acting thereon over a comparatively long period at each plastics-material corner foot.

8 Claims, 4 Drawing Sheets

(51) Int. Cl.
*B65D 19/38* (2006.01)
*B65D 19/40* (2006.01)

(52) U.S. Cl.
CPC ..... *B65D 19/40* (2013.01); *B65D 2213/00* (2013.01); *B65D 2213/02* (2013.01); *B65D 2519/00024* (2013.01); *B65D 2519/00243* (2013.01)

(58) Field of Classification Search
USPC ..... 206/386
See application file for complete search history.

(56) References Cited

U.S. PATENT DOCUMENTS

| | | | | |
|---|---|---|---|---|
| 7,017,499 | B2 * | 3/2006 | Schutz | B65D 77/0466 108/51.11 |
| 7,908,980 | B2 * | 3/2011 | Schmidt | B65D 77/0466 108/51.11 |
| 8,505,721 | B2 * | 8/2013 | Schutz | B65D 77/0466 206/386 |
| 9,233,777 | B2 * | 1/2016 | Weyrauch | B65D 77/0466 |
| 2004/0107879 | A1 * | 6/2004 | Schutz | B65D 77/0466 108/51.11 |
| 2005/0115473 | A1 * | 6/2005 | Schutz | B65D 19/10 108/55.1 |
| 2009/0000525 | A1 * | 1/2009 | Schmidt | B65D 77/0466 108/57.3 |
| 2012/0037528 | A1 * | 2/2012 | Schutz | B65D 77/0466 206/386 |
| 2012/0055830 | A1 * | 3/2012 | Schutz | B65D 77/0466 206/386 |
| 2013/0098801 | A1 * | 4/2013 | Schutz | B65D 21/0213 206/599 |
| 2019/0016503 | A1 * | 1/2019 | Weyrauch | B65D 77/0466 |

FOREIGN PATENT DOCUMENTS

| | | | |
|---|---|---|---|
| DE | 29520143 | U1 | 2/1996 |
| DE | 10161693 | A1 | 7/2003 |
| DE | 102011052639 | A1 | 2/2013 |
| RU | 2012114725 | A | 10/2013 |
| WO | WO-2012085941 | A1 | 6/2012 |

OTHER PUBLICATIONS

English Translation of DE 102011052639 (Year: 2013).*
International Search Report for International Application No. PCT/EP2016/001523, dated Nov. 18, 2016.
Chinese Search Report for application No. 201680055717.3, dated Sep. 9, 2016.

* cited by examiner

PALLET CONTAINER

CROSS-REFERENCE TO RELATED APPLICATIONS

This is the United States national phase of International Patent Application No. PCT/EP2016/001523 filed Sep. 9, 2016, which claims the priority benefit of German Application No. 10 2015 012 163.4, filed on Sep. 23, 2015. The entire contents of each of the foregoing applications are incorporated herein by reference.

FIELD OF THE DISCLOSURE

The invention relates to a pallet container for storing and transporting in particular flammable or easily ignitable liquid filling materials, having a thin-walled rigid internal container made from a thermoplastic plastics material for receiving the liquid filling material, having a tubular lattice frame from tubes that are welded to one another, said tubular lattice frame as a supporting jacket tightly enclosing the plastics-material internal container, and having a base pallet on which the plastics-material container bears and to which the tubular lattice frame is fixedly connected, wherein the plastics-material internal container within the tubular lattice frame is enclosed by a fire-protection insulation mat, and the base pallet is designed as a composite pallet from a steel-sheet frame having plastics-material feet.

BACKGROUND

A similar pallet container having a steel pallet is known from DE 197 47 690 A1, which pallet container is said to be distinguished by a fire-retardant construction mode and is said to have adequate resistance to fire. To this end, in this pallet container, a thin-walled thermal insulation which is composed of cardboard and aluminum foil is disposed between the plastics-material internal container and the lattice cage. This plate-shaped insulation is said to be employed also between the inner container lower base and the pallet upper base, at least in the case of steel pallets. It is disadvantageous in the case of this known embodiment that the base-side retrieval fitting and the entire internal-container upper base with the filling connector and the screw cap remain free and readily accessible, these components thus being exposed to the flames of an adjacent fire in a completely unprotected manner. On account thereof, such a pallet container having inadequate protection against flames may resist the influences of a fire that acts from the outside for only a very short time.

Another pallet container with a fire-protection equipment on the steel pallet, in which a fire-protection jacket that is composed of sheet-metal boards, and an additional fire and heat insulation which also covers the upper and the lower base of the plastics material internal container, are disposed between the internal container and the lattice frame is disclosed in DE 101 61 693 A1. In order for electrical charges to be dissipated, the plastics-material internal container is moreover enclosed by a lattice-type sheathing from thin metal wire. This known pallet container with improved fire protection equipment is said to meet the fire-protection guidelines according to US standard NFPA-30, pertaining to the storage of flammable and easily ignitable liquids, that are monitored by Underwriters Laboratories (UL), and in the case of a fire is said to protect the internal bladder from damage or from leakage of the liquid filling material for at least 20 minutes when supported by a sprinkler installation.

In the case of a pallet container having a wooden pallet, which is known from EP 1481918 A1, a sheet-metal discharge plate which is to represent an electrical connection from the metal lattice cage to the ground is attached to at least one pallet foot, in order for electrical charges to be dissipated. An improved solution to the same problem area is described in EP 2433880 A1. Therein, in the case of a pallet container having a skid-pallet, at least one plastics-material foot having a sheet-metal formed part which for dissipating an electrical charge is disposed in a clearance within the plastics-material foot, said sheet-metal formed part having a standing contact portion and a stacking contact face. Furthermore, a respective plastics-material container having a metallic sheet-metal formed part within a pallet corner foot for discharging electrical charges to the hard standing is known from document JPH11157535 (A). In the last-mentioned prior art, the focus is exclusively that of preventing electrical charges in the pallet containers or in the plastics-material internal containers, respectively; a use in an application with fire protection is not provided in the case of these liquids containers.

GENERAL DESCRIPTION

Problem Area

It can arise in an application of composite pallets having plastics-material corner feet for UL-IBCs that in the case of a fire that persists for a comparatively long time, these plastics-material corner feet start to soften under the effect of external heat and thereafter start to burn. On account thereof, the stability under load of filled pallet containers is heavily compromised, and in the case of pallet containers stacked on top of one another such a stack can even fall over. Of course, this particular problem area does not arise in the case of pure steel pallets.

It is an object of the present invention to refine a pallet container equipped with a composite pallets from a steel-sheet frame and with plastics material feet with flame-protection equipment in such a manner that the existing disadvantages of the prior art are overcome, and that by way of a particular construction of said pallet container an adequate resistance to fire together with a consistent stability under load is provided even in the case of an increased thermal stress such as, for example, in the case of a direct effect of fire.

Solution

This object is achieved by the special features of patent claim 1. The features in the dependent claims describe further advantageous potential design embodiments of the pallet container according to the invention. The proposed technical teaching opens up an application of the composite pallet in the case of a UL-IBC, wherein the stability under load (stacking load capability) is maintained in particular for filled UL-IBCs that are stacked on top of one another, and a toppling over of the UL-IBC is prevented. This is effectively achieved in that each plastics-material corner foot is assigned a least one separate heat-resistant support element which is configured in such a manner that said support element transmits high compression forces in the vertical direction, even at a high thermal stress. On account thereof, a plastics-material corner foot per se can soften and even burn without the stability under load of filled UL-IBCs stacked on top of one another being disadvantageously compromised in the case of a fire. The support element is advantageously disposed within the plastics-material corner foot without being visible from the outside, and is supported toward the top on an upper angular rail that runs on the external periphery of the upper support plate, and is supported toward the bottom on the encircling bar tubular bar structure.

Various heat-resistant materials (for example, ceramic parts, aluminum parts, or the like) can be considered for the support element. However, the support element is preferably made from a stable elongate steel-sheet strip, and by a simple punching and bending method is crimped, folded, and/or bent to a hollow tubular support member. In a preferred constructive design embodiment the hollow support element on account of alternating bent features is configured in such a manner that said support element has a planar side wall (base-structure side wall) and two mutually opposite side walls that are molded in an inward V-shaped manner.

Expediently, in the hollow supporting element at the upper and lower ends, a cover part or base part formed in one piece is integrally formed on each of the upper and lower ends by bending out of a side wall in such a way that the upper cover part and the lower base part of the support element each cover the two inwardly formed angled side walls and are supported against them. Since the support element in practice is stressed less by a tensile load but much rather by a heavy compressive load, the upper lid part of the hollow support element within the plastics-material corner foot toward the top is fixedly connected (riveted or screw-fitted, for example) to the angular rail that runs on the external periphery of the upper support plate, and toward the bottom is fixed with the lower base part on the encircling tubular bar structure on the base, wherein the support element is otherwise free of any direct fixed connection to the plastics-material corner foot and thus does not exert any stress on the latter.

BRIEF DESCRIPTION OF THE DRAWINGS

The invention will be explained and described in more detail hereunder by means of a preferred exemplary embodiment that is illustrated in the drawings in which.

DETAILED DESCRIPTION OF THE DRAWINGS

Figure 1:
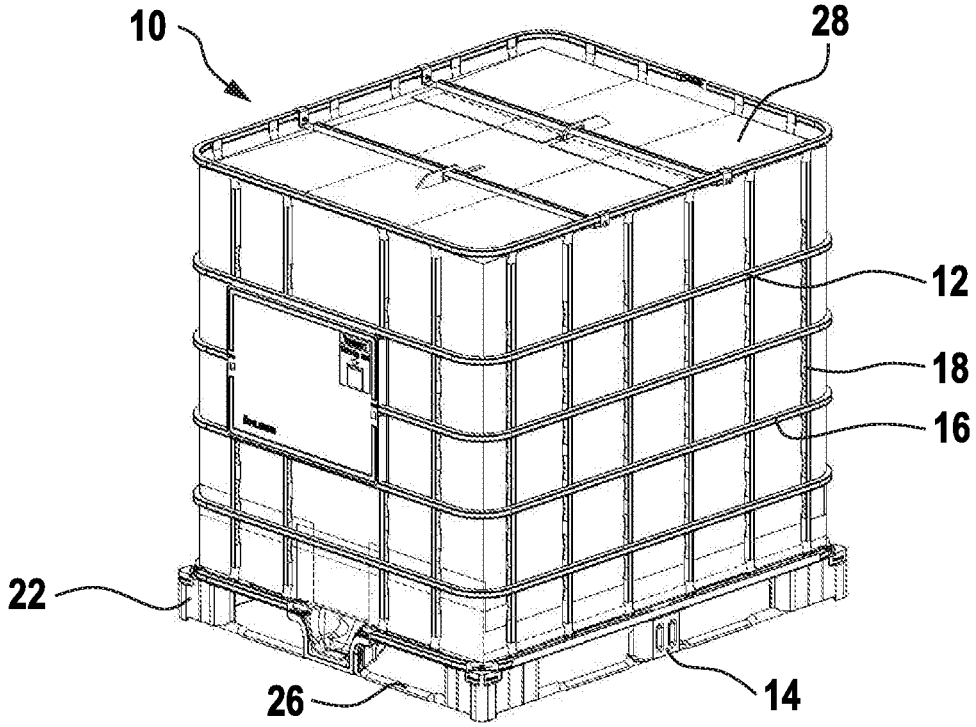
FIG. 1 in a perspective view shows a pallet container according to the invention on a composite pallet having a fire-protection equipment.

A pallet container (UL-IBC) according to the invention, having a filling volume of 1000 l, having a thin-walled rigid internal container (not visible) made from a thermoplastic plastics material for storing and transporting in particular hazardous flammable liquids, having a tubular lattice frame 12 that as a supporting jacket tightly encloses the plastics-material container, and having a base pallet 14 on which the plastics-material container bears and to which the supporting jacket is fixedly connected is referred to with the reference sign 10 in FIG. 1. The tubular lattice frame 12 (external container) of the pallet container 10 is composed of welded-together vertical and horizontal tubes 16, 18. In order for a closed external container to be obtained, the encircling horizontal tubes 16 are in each case connected to one another. The base pallet 14 is configured as a composite pallet (tubular steel frame with plastics-material feet), having an upper support plate 20 from steel sheet for bearing the plastics-material internal container, having corner feet 22 and central feet 24 that are produced by the injection-molding method from a thermoplastic plastics material, and in this case having an encircling base tubular bar structure 26 from steel tubing below the corner and central feet 22, 24.

In the case of this pallet container 10 a fire-protection insulation mat 28 as a complete sheathing is disposed directly between the tubular lattice frame 12 and the plastics-material internal container. The upper base and the lower base (=pallet bearing) of the plastics-material internal container are also covered and protected by the fire-protection insulation mat 28. Respective overlapping access flaps for access to the upper filling opening and to the lower retrieval fitting are incorporated in the insulation mat 28.

Figure 2:
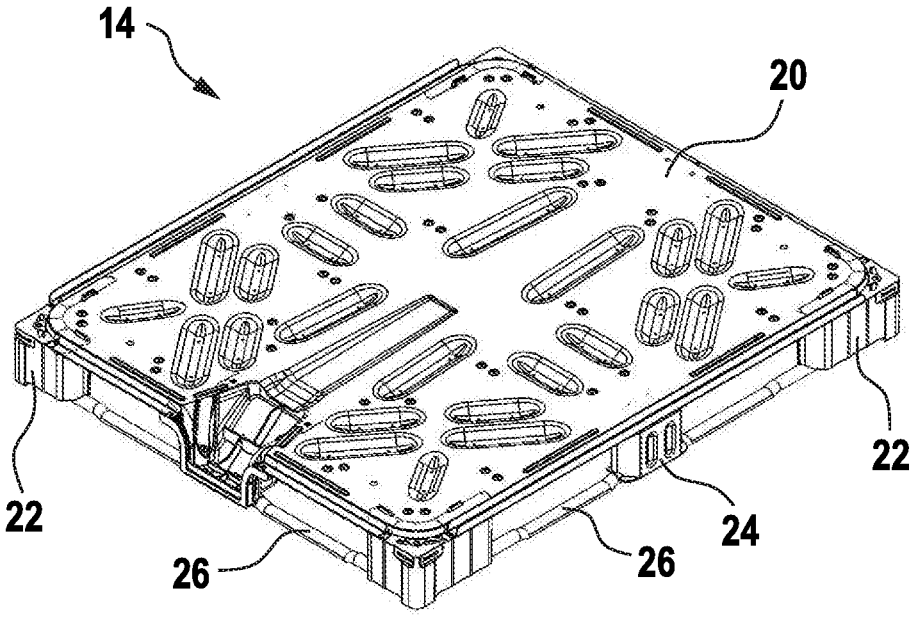
FIG. 2 shows the composite pallet according to FIG. 1 in a perspective view.

FIG. 2 shows the composite base pallet 14 of the pallet container 10 from FIG. 1 in a perspective view, having the upper support plate 20 from steel sheet, the plastics-material corner feet 22 and central feet 24, and the lower encircling base tubular bar structure 26 from steel tubing; the tubular lattice frame, the plastics-material internal container, and the f ire-protection insulation mat have been removed here.

Figure 3:
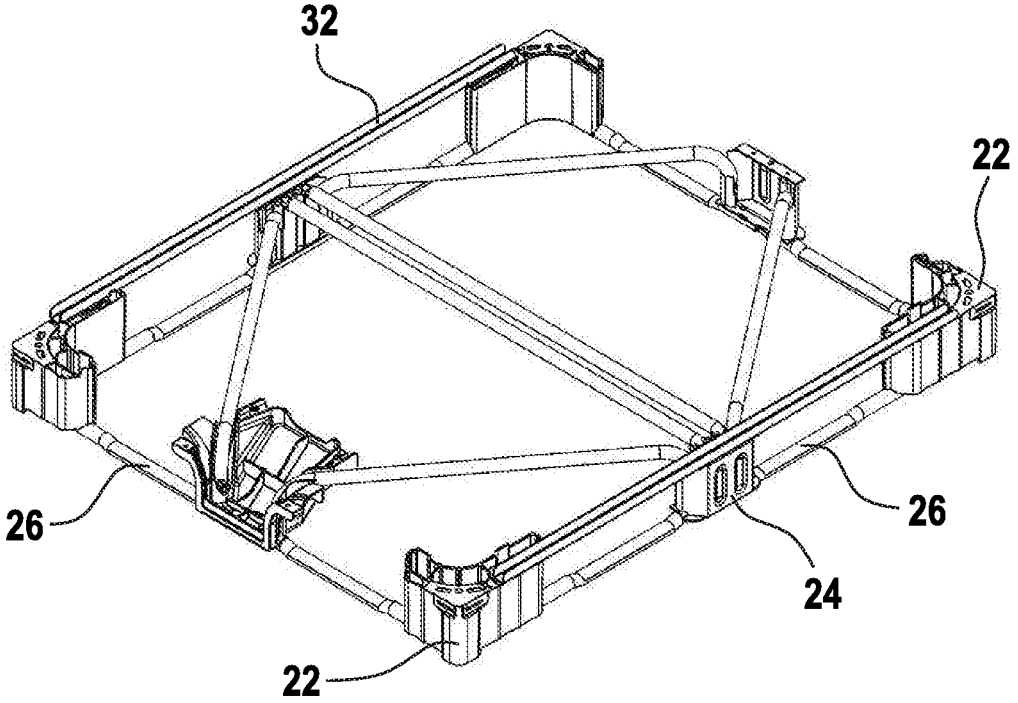
FIG. 3 shows the composite pallet according to FIG. 2 without the lid plate, in a perspective view.
Figure 4:
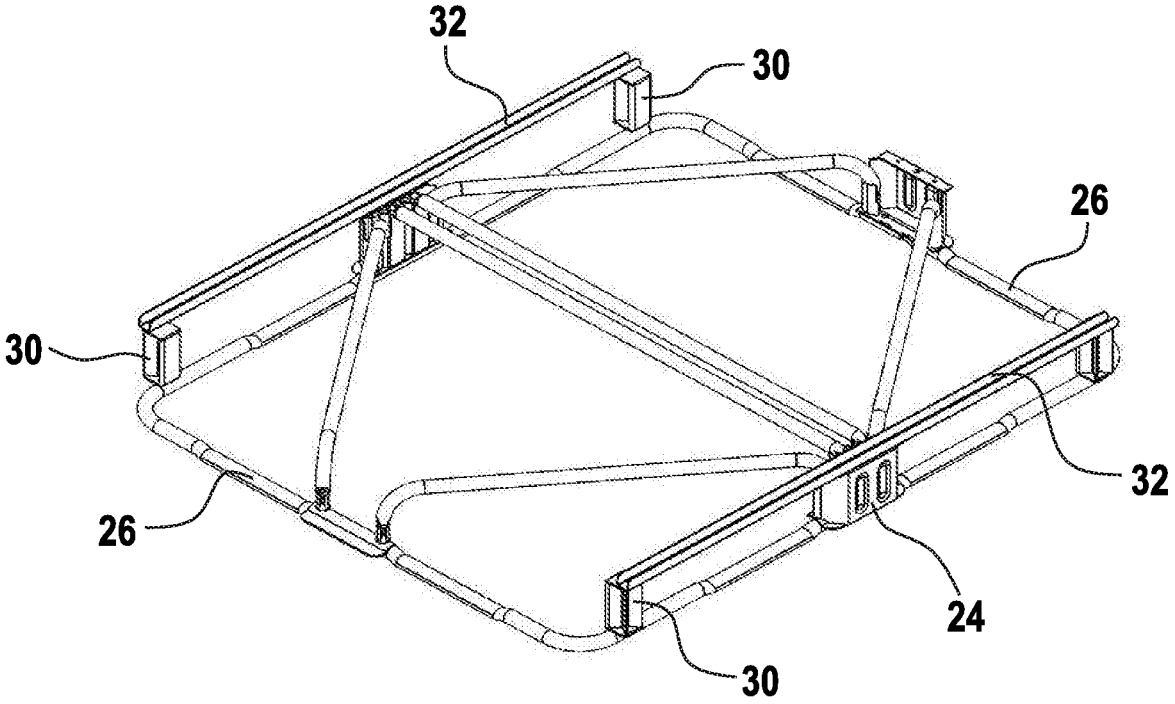
FIG. 4 shows the composite pallet according to FIG. 2 without the lid plate and without plastics-material corner feet, in a perspective view.

The composite base pallet according to FIG. 2 is shown in the same manner in a perspective view in FIG. 3, now also without the upper steel-sheet support plate 20. Here, the upper support tube frame directly below the support plate 20 is visible now. The upper support tube structure is composed of two steel tubes that run close to one another so as to be mutually parallel between two lateral central feet 24 and four steel tubes which run diagonally between all four central feet 24 and, conjointly with the steel-sheet support plate 20 and two angular rails 32 that run on the longitudinal sides of the composite base pallet 14, form the upper support frame of the pallet. The corner and central feet (22, 24) form the spacing from the bearing floor and achieve the space required for the fork prongs of a forklift truck to engage. The corner and central feet (22, 24) on the base are fastened to the encircling base tubular bar structure 26 from steel tubing, so as to stabilize said composite base plate 14. The upper support tube structure is not relevant in terms of the explanation of the present invention and will thus not be described any further. Rather, the present invention is focused on the plastics-material corner feet 22 having the support elements 30 installed therein. The illustration in FIG. 3 is intended to facilitate the understanding of the construction of the composite pallet and to ultimately highlight the positioning of the support element 30. To this end, the composite pallet in FIG. 4 is further "denuded", and is now also illustrated in a perspective view without the plastics-material corner feet, such that the arrangement of the four support elements 30 can now be seen, this normally not being the case since the support elements are fixed within the plastics-material corner feet without being visible from the outside.

Figure 5:
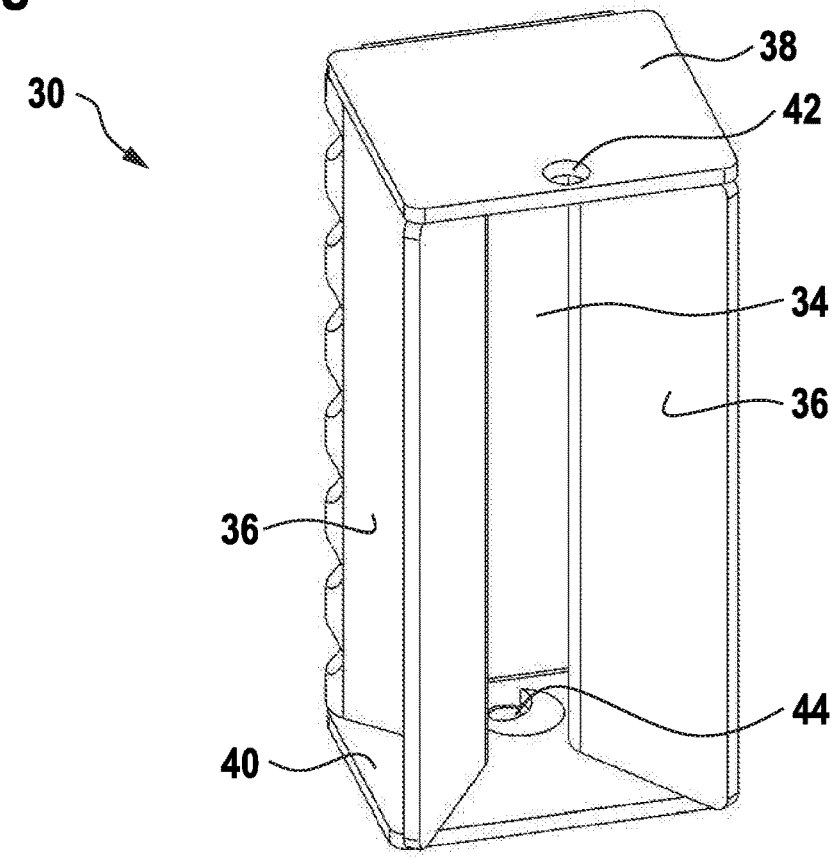
FIG. 5 shows a support element from a plastics-material corner foot, in a perspective view.

The constructive shaping of a support element 30 is specifically illustrated in a perspective view in FIG. 5. It becomes evident here that the support element 30 is composed of a stable elongate steel-sheet strip and is crimped, or folded, respectively, and bent to a hollow tubular support member. The hollow support element 30 on account of alternating bent features of the elongate steel-sheet strip is configured in such a manner that said support element 30 has a planar side wall 34 (rear base-structure side wall) and two mutually opposite side walls 36 that are molded in an inward V-shaped manner. In each case one upper lid part 38 and one base part 40 have been molded on the hollow support element 30 at the upper and the lower end on account of further bent features of the planar side wall 34, wherein the upper lid part 38 and the lower base part 40 of the support element 30 in each case cover the two side walls 36 that are molded in an inward V-shaped manner and are supported thereon. The wall thickness of the steel-sheet strip is approximately 2 mm; the dimensions of the support element 30 in terms of the height are approx. 90 mm and for the lid or base part, respectively, approximately 40×40 mm.

The "toothing" that is identifiable on the left periphery of the support element 30 represents the connecting line between the left inwardly angled side wall 36 and the planar rear base-structure side wall 34. This here are a multiplicity of punched holes which facilitate the bending of the two inwardly angled side walls 36 by an angle of more than 90° (in this case approx. 135°).

Figure 6:
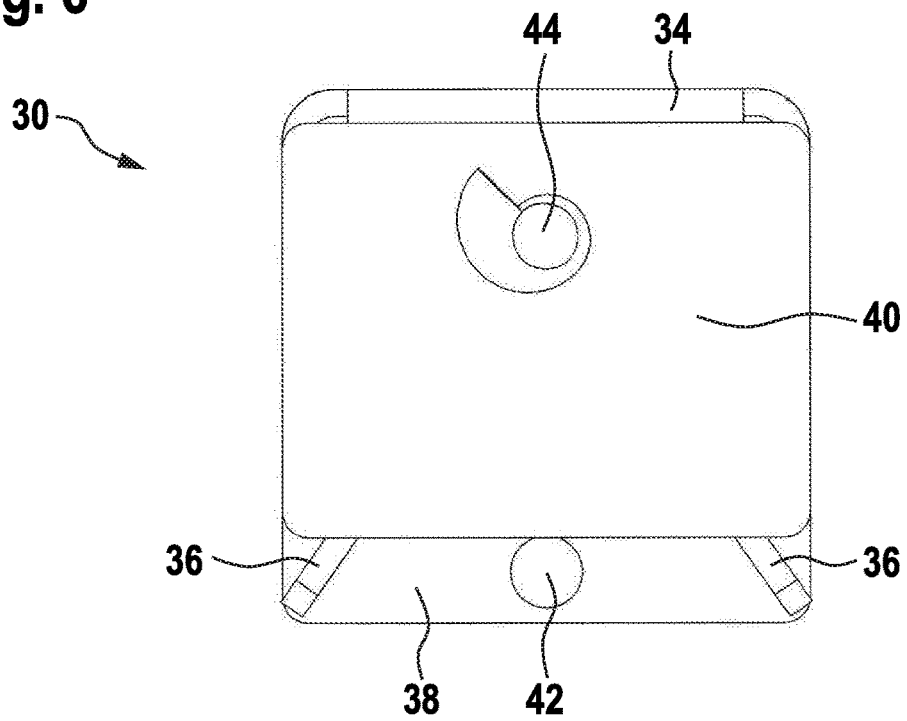
FIG. 6 shows a base view of the support element according to FIG. 5.

FIG. 6 also shows a base view of the support element 30 according to FIG. 5, with a view toward the lower base part 40 which from the planar rear base-structure side wall 34 that can be seen above has been bent downward by an angle of 90°. In the same manner, the upper lid part 38 of which only a short piece can be seen here, has been bent back from the planar rear base-structure side wall 34 by 90°. In each case only a piece of the two side walls 36 that have been inwardly angulated can be seen here too. In the normal installed case, the upper lid part 38 is supported from above and the lower base part 40 is supported from below on the two inwardly angulated side walls 36. The lower base part 40, fully visible here, has a bore which has been located so as to be somewhat eccentric and which has a lateral slot 44 and a threaded molding for screw-fitting a threaded bolt. As can just still be seen, the upper lid part 38 on the lateral periphery has a plain bore 42 for incorporating a riveted connection.

Figure 7:
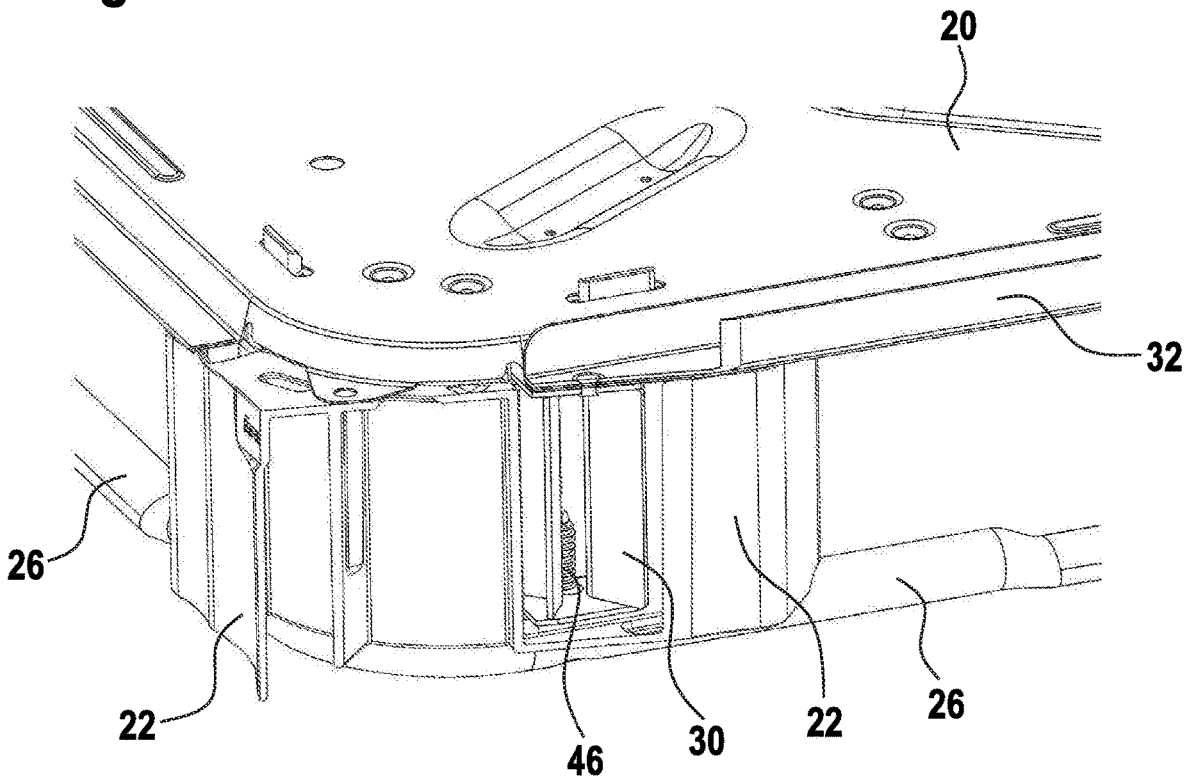
FIG. 7 shows a perspective partial view from the outside of a corner of the composite pallet according to FIG. 2, having the plastics-material corner foot cut open, and the support element inserted.

Finally, a perspective partial external view of a corner of the composite pallet is illustrated in FIG. 7, in which the plastics-material corner foot 22 is cut open on the front side such that the fixedly installed support element 30 becomes visible, the latter by means of a riveted connection (through the plain bore 42) is fixedly riveted to an upper angular rail 32 that runs on the external periphery of the upper support plate 20 and at the bottom by means of a counter-sunk threaded bolt 46 that is driven from below (through the somewhat eccentrically located bore having the lateral slot 44 and the threaded molding) is fixedly screw-fitted to the encircling base tubular bar structure 26. The plastics-material corner foot 22 herein is free of any direct fixed connection to the support element 30 or to the connection means of the latter. Fastening bolts that are directly driven into the plastics material of the plastics-material corner and central feet (22, 24) and which are often ripped out in the case of excessive stress, are dispensed with at this location.

As a spin-off, so to speak, the present solution according to the invention also offers the advantage that an additional electrical discharge device for the usually non-conductive plastics-material feet can be dispensed with. In the case of UL-IBCs and the application of the latter in easily inflammable or explosive liquid filling materials, a device or a measure, respectively, for discharging electrical charges into the hard standing is a mandatory requirement according to the required homologation regulations. The support elements 30 in the four plastics-material corner feet 22 toward the top are screw-fitted to the upper steel sheet angular rail 32 that runs on the external periphery of the upper steel sheet support plate 20 (and to the tubular lattice frame 12), on the one hand, and to the encircling base tubular bar structure 26 at the bottom, on the other hand. On account thereof, an electrical grounding of the discharge-capable blow-molded plastics-material internal container by way of the conductive internal layer to the woven-fabric external side of the fire-protection insulation mat 28 and thus toward the tubular lattice frame 12, or toward the base plate 14, respectively, is guaranteed.

The measures outlined above of the present invention enable a particular pallet container with a flame-protection device=UL-IBC, even having a composite pallet with otherwise heat-sensitive plastics-material pallet feet, to be refined in such a manner that said pallet container withstands an external influence by flames at least for a duration of approx. 25 minutes.

It is achieved on account of these measures according to the invention that a unilateral buckling of the pallet feet and a subsequent toppling over of two filled UL-IBCs that are stacked on top of one another is prevented in the case of an influence of heat by fire and of the onset of softening of the thermoplastic plastics material of the pallet feet.

CONCLUSION

The plastics-material corner feet of "normal" composite pallets in an application as UL-IBCs represent a weak spot which, as has become evident from the above description and from the illustrations of the figures, can be readily remedied by the technical teaching of the present invention.

LIST OF REFERENCE SIGNS

10 Pallet container
12 Tubular lattice frame
14 Base pallet
16 Horizontal tubular bars (12)
18 Vertical tubular bars (12)
20 Upper steel-sheet support plate (14)
22 Plastics-material corner foot (14)
24 Plastics-material central foot (14)
26 Base tubular bar structure (14)
28 Fire-protection insulation mat (10)
30 Support element (22)
32 Angular rail (14)
34 Planar side wall (30)
36 Angled side wall (30)
38 Upper lid part (30)
40 Lower base part (30)
42 Plain bore (38)
44 Bore having a lateral slot (40)
46 Threaded bolt (44)

The invention claimed is:

1. A pallet container for storing and transporting in particular flammable or easily ignitable liquid filling materials, the pallet container having a thin-walled rigid internal container made from a thermoplastic plastics material, having a tubular lattice frame from horizontal and vertical tubular bars that are welded to one another, said tubular lattice frame is a supporting jacket tightly enclosing the plastics-material internal container, wherein the plastics-material internal container is enclosed by a fire-protection insulation mat, and having a base pallet on which the plastics-material internal container bears and to which the tubular lattice frame is fixedly connected, wherein the base pallet is configured in a composite embodiment having an upper support plate produced from steel sheet, having corner feet and central feet that are produced from a thermoplastic plastics material, and having an encircling base tubular bar structure produced from steel tubing below the corner and central feet, wherein the corner feet and the central feet are produced from a thermoplastic plastics material in an injection molding process, and wherein each plastics-material corner foot includes at least one separate fire-resistant support element which is designed in such a manner that said support element transmits high compression forces in the vertical direction, even at a high thermal stress, wherein the support element is composed of a stable elongate steel-sheet strip, and is crimped, folded, and/or rolled to a hollow tubular support member, and on account of alternating bent features is configured in such a manner that said support element has a planar side wall and two mutually opposite side walls that are molded in an inward V-shaped manner, and at the upper and the lower end has in each case one lid part or base part, respectively, that has been created by bent features from the planar side wall.

2. The pallet as claimed in claim 1, wherein the support element is disposed within the plastics-material corner foot without being visible from the outside, and is supported toward the top on an upper angular rail that runs on an external periphery of the upper support plate, and is supported toward the bottom on the encircling base tubular bar structure.

3. The pallet as claimed in claim 1, wherein the lid part and the base part of the support element in each case cover the two side walls and are supported thereon.

4. The pallet as claimed in claim 1, wherein the lid part of the support element within the plastics-material corner foot toward the top is connected to an angular rail that runs on the external periphery of the upper support plate, and the support element toward the bottom, by way of the base part, is fastened to the encircling tubular bar structure on the base, and is otherwise free of any direct fixed connection to the plastics-material corner foot.

5. The pallet as claimed in claim 1, wherein the lid part of the support element on an external periphery has a plain bore and by means of a riveted connection is fixedly riveted to an angular rail that runs on the external periphery of the upper support plate.

6. The pallet as claimed in claim 1, wherein the lid part of the support element by means of a screw connection is fixedly screw-fitted to an angular rail that runs on the external periphery of the upper support plate.

7. The pallet as claimed in claim 1, wherein the base part has an eccentric bore having a lateral slot and threaded moldings, and by means of a threaded bolt is fixedly screw-fitted from below to the encircling tubular bar structure on the base.

8. The pallet as claimed in claim 1, wherein the two mutually opposite side walls of the support element are laterally connected.

* * * * *